United States Patent [19]

Hofmann

[11] 4,319,717

[45] Mar. 16, 1982

[54] SPRAY GUN FOR APPLYING GRANULATED MATERIAL

[75] Inventor: Frank Hofmann, Hamburg, Fed. Rep. of Germany

[73] Assignee: Firma Walter Hofmann, Fed. Rep. of Germany

[21] Appl. No.: 115,316

[22] Filed: Jan. 25, 1980

[30] Foreign Application Priority Data

Jan. 27, 1979 [DE] Fed. Rep. of Germany ..... 7902264

[51] Int. Cl.[3] ..... E01C 23/16

[52] U.S. Cl. ..... 239/654; 239/155; 239/424

[58] Field of Search ..... 239/654, 155, 156, 214.11, 239/214.21, 215, 331, 332, 412, 416.5, 424, DIG. 8; 404/93, 94

[56] References Cited

U.S. PATENT DOCUMENTS

| | | | |
|---|---|---|---|
| 1,755,329 | 4/1930 | McCormack | 239/654 |
| 1,797,112 | 3/1931 | Welsh et al. | 239/654 |
| 2,059,950 | 11/1936 | Johnson | 239/654 |
| 2,597,323 | 5/1952 | Hiller, Jr. et al. | 239/654 |
| 2,975,543 | 3/1961 | Funk | 239/654 |
| 3,102,731 | 9/1963 | Burkhard | 239/654 |
| 3,233,832 | 2/1966 | Hallberg | 239/155 |
| 3,356,261 | 12/1967 | Stein | 239/156 |

*Primary Examiner*—Robert B. Reeves
*Assistant Examiner*—Michael J. Forman
*Attorney, Agent, or Firm*—Allison C. Collard; Thomas M. Galgano

[57] ABSTRACT

A spray gun for applying granulated material onto a surface, preferably glass beads onto roadway markings, or the like, is characterized in that a bead spray gun with an ejection effect is coupled with a mechanical dosaging device in one structural unit. Preferably, the mechanical dosaging device is a roller bead sprayer and is mounted immediately in the housing of the air spray gun above an ejection air nozzle.

8 Claims, 2 Drawing Figures

SPRAY GUN FOR APPLYING GRANULATED MATERIAL

Figure 1:
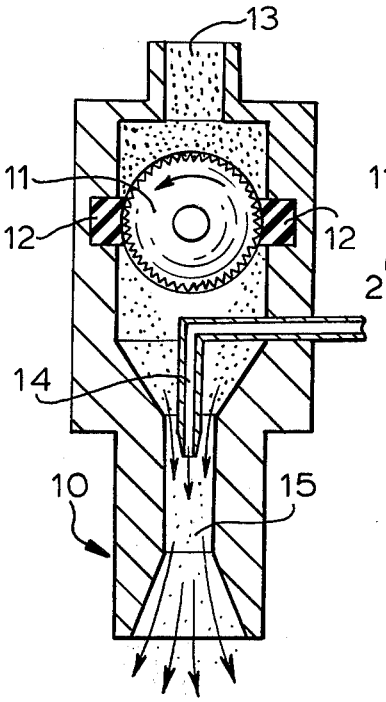

The present invention relates to a spray gun for applying granulated material onto a surface. More particularly, it relates to a spray gun for applying glass beads onto roadway markings or the like.

For example, different types of devices are known and are in use for applying light-reflective glass beads. These beads are typically applied to the freshly mounted and still wet marking material used for traffic directional lines.

Devices are known wherein the glass beads drop onto the surface to be beaded due to their own weight in a free fall. In these devices the so-called "roller bead" sprayer is of particular importance since it operates in accordance with the principle of a bucket wheel charging valve. In particular, it is provided with a roller or bucket wheel having longitudinal grooves or other suitable recesses which are filled with the glass beads. The beads drop in a free fall to the marking to be beaded when the roller or bucket wheel is turned.

The advantage of this device is that an exactly defined material quantity is discharged depending on the rate of rotation of the bucket wheel. When one couples the rotational speed of the wheel with the travelling speed of the machine, for example, by means of a friction wheel drive which rolls on the roadway, then the applied amount of beads per surface unit remains constant even when changing speeds. This advantage is contrasted by the disadvantage that the energy of the freely falling beads is rather low. Consequently, they cannot penetrate deeply enough into the marking material, so as to securely adhere thereto, particularly if this material is already dried to a certain extent. Furthermore, during strong winds the beads may be deflected from a straight downward direction or may be even carried away entirely.

In order to eliminate these disadvantages, the bead material is sprayed onto the roadway with spray guns. The spray guns employ an air stream to accelerate the beads, so that they are forced through a jet nozzle at a high speed onto the roadway. As a result, the beads penetrate deeply into the marking material sufficiently enough to ensure secure adhesion thereto, even if the material is dried to a certain extent. However, these devices have the disadvantage that the material volume flow is only dependent on the air stream for an unchanged geometry or spray pattern of the spray gun and the flow remains constant even when changing the drive speed, provided one adds a costly control mechanism to the device.

However, due to the difficulties for providing a control system, as discussed below, such control systems do not exist as of yet. In particular, a common problem with all of the known bead spray guns, whether they operate with a direct blowing of the air stream into the bead supply or if they operate with an ejector effect, is the dependency of the fed bead quantity per unit time on the air pressure and the characteristics of the beads, under otherwise the same conditions. As defined herein, the characteristics of the beads are not only understood to be the size of the beads, but also the uniformity of the size distribution within the bead supply. This bead supply generally fluctuates because demixing occurs due to the vibrations in the processing machines; this, of course, resulting in an uneven size distribution. However, the size distribution influences the flow resistance of the beads in the feed line to the gun. When the resistance increases, the flow of beads decreases. Therefore, the dimension of the bead flow always fluctuates with a non-uniform size distribution of the beads.

Under otherwise unchanged or the same conditions, a defined bead flow may be provided for a defined air flow. A defined drive speed may be provided for the machine and for the bead flow, so that one obtains a defined quantity of beads per surface unit. However, in practical application, this is rather difficult to accomplish because following extensive calculations, a diagram or chart would have to be prepared to take into account various operational parameters or dependencies because, due to the different influences such as the changes in the friction conditions, feeding line lengths, changes in the glass bead mixtures and compositions, etc., more or less large deviations would result in the nominal curve of a diagram theoretically established. If it is necessary that the bead quantity per surface unit or per unit of travelled roadway remains constant, the bead flow must be adjusted by changing the air pressure in accordance with the bead supply when changing the vehicle speed. This is hardly possible without a control unit, particularly under conditions of abrupt and constant speed changes.

It is therefore an object of the present invention to eliminate the aforementioned disadvantages of the known bead applying devices.

This object of the invention is attained by the provision of a simple and operationally safe bead gun which encompasses the advantages of the known devices. In particular, in accordance with the invention, an air gun with an ejector effect is provided which is coupled in a single structural unit with a mechanical dosaging device for the spray material in a spray gun of the aforementioned type. Preferably, a bucket wheel or a roller bead sprayer is provided directly in the housing of the ejector spray gun above the air jet or nozzle.

The dosaging device is coupled with a drive responsive to the drive of the machine. For example, this could be a friction roller riding on the roadway which is removable therefrom so as to interrupt the markings. Alternatively, it may have a drive derived from the machine, the rotational speed of which would be proportional to the drive speed of the machine.

In order to change the fed quantities of beads per travelled roadway, a control gear with an infinitely variable transmission may be provided. Alternately, a roller chain drive may be used wherein the transmission change is carried out by exchanging the corresponding chain or sprocket wheels.

For interrupting the flow of the spray material, so as to interrupt the markings in an interrupted traffic direction line, the friction wheel for the dosaging device which is riding on the roadway may be removed therefrom or a cover plate may be slid over the bucket wheel, so that a charging of this bucket wheel with spray material is prevented. However, it has been shown to be very advantageous to provide the dosaging device with a pneumatically- or hydraulically-actuated clutch, wherein a friction disc which is mounted on a drive shaft is brought into a frictional or positive coupling engagement with a friction disc which is mounted on a shaft of the dosaging device, after a piston is admitted by a pressurized medium.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

Figure 2:
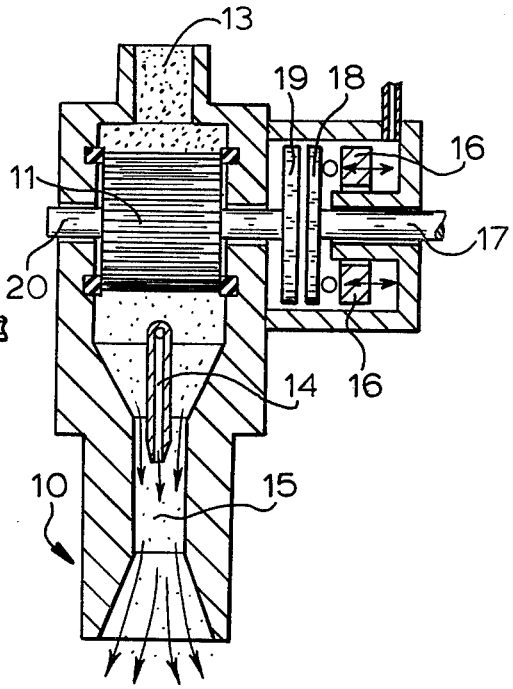

In the drawing, wherein similar reference characters denote similar elements throughout the several views:

FIG. 1 is a schematically-illustrated sectional view through the housing of the inventive spray gun; and FIG. 2 is another schematically-illustrated sectional view through the same spray gun housing, but taken at a right angle thereto.

As can be seen from the drawing, a bucket wheel 11, having circumferentially-disposed, longitudinally-extending grooves, is fed spray material by means of a charge opening 13 and is disposed between a pair of opposing sealing bars 12. When turning bucket wheel 11 past sealing bars 12, the spray material drops into the chamber below the bucket wheel. The bead-charged grooves are emptied due to gravity. The spray material then collects in a funnel-shaped opening of a discahrge nozzle 15, partly due to gravity and partly due to the vacuum created by an air stream which discharges under excess pressure from an air nozzle 14. The spray material is collected by the expanding air stream, accelerated and discharged in a cone-shaped pattern at a high speed. The drive of bucket wheel 11 is such that the rotational speed is always proportional to the drive speed of the machine on which this bead application device is mounted. This may be carried out by either a friction roller which rides on the roadway or by a drive derived from the machine, the rotational speed of which is proportional to the drive speed of the machine.

For interrupting the flow of the spray material for making interruptions in a traffic directional line, a pneumatic or hydraulic clutch may be used. This may include a friction disc 18 which is mounted on a drive shaft 17 and which is brought into frictional or positive clutching engagement with a friction disc 19 which is mounted on a shaft 20 or the dosaging device, after a piston 16 is admitted by a pressurized medium.

While only a single embodiment of the present invention has been shown and described, it will be obvious that many modifications and changes may be made thereunto, without departing from the spirit and scope of the invention.

What is claimed is:

1. An apparatus for applying glass beads onto roadway markings, comprising:

a housing having an upper feed opening adapted to be connected to a source of glass beads and a discharge conduit including a generally funnel-shaped upper section, a relatively narrow intermediate section and a lower, downwardly-directed, outwardly-flared nozzle-shaped section having a downwardly-directed discharge opening;

a dosaging device mounted in said housing for dosaging glass beads to be applied to roadway markings in a defined amount per surface area to be covered;

an air spray gun adapted to be connected to a pressurized source of air mounted in said housing having an air ejection nozzle disposed beneath said dosaging device and centrally above said discharge opening for directing an air stream and said glass beads dosaged by said dosaging device downwardly and through said discharge opening, said nozzle having a tip portion which extends from said upper section of said discharge conduit into said intermediate section thereof; and drive means for said dosaging device which is responsive to the drive speed of a roadway marking machine.

2. The spray gun in accordance with claim 1, wherein said drive means has a drive shaft, the rotational speed of which is proportional to the drive speed of said machine.

3. The spray gun in accordance with claim 1, wherein said drive means includes a clutch.

4. The spray gun in accordance with claim 3, wherein said clutch is actuated by a cylinder having a piston operated by a pressurized medium, wherein said dosaging device is directly coupled to said clutch and wherein said clutch includes a first friction disc which is mounted on a drive shaft of said dosaging device, a second friction disc which is mounted on a second drive shaft, and which is brought into frictional, positive coupling engagement with said first friction disc after said piston is admitted by a pressurized medium.

5. The spray gun in accordance with claim 3, wherein said clutch is hydraulically activated.

6. The spray gun in accordance with claim 3, wherein said clutch is pneumatically activated.

7. The apparatus according to claim 1, wherein said dosaging device comprises a bucket wheel having circumferentially-disposed, longitudinally-extending grooves for receiving said glass beads and a pair of opposing sealing bars mounted in said housing and disposed on opposite sides of, and closely adjacent to, said bucket wheel for positive cooperation therewith in dosaging the glass heads fed therepast in said grooves of said bucket wheel.

8. An apparatus for applying glass beads onto roadway markings, comprising:

a housing having an upper feed opening adapted to be connected to a source of glass beads and a discharge conduit including a generally funnel-shaped upper section, a relatively narrow intermediate section and a lower, downwardly-directed, outwardly-flared nozzle-shaped section having a downwardly-directed discharge opening;

a dosaging device mounted in said housing for dosaging glass beads to be applied to roadway markings in a defined amount per surface area to be covered, said dosaging device comprising a bucket wheel having circumferentially-disposed, longitudinally-extending grooves for receiving said glass beads and a pair of opposing sealing bars mounted in said housing and disposed on opposite sides of, and closely adjacent to, said bucket wheel for positive cooperation therewith in dosaging the glass beads fed therepast in said grooves of said bucket wheel;

an air spray gun adapted to be connected to a pressurized source of air mounted in said housing having an air ejection nozzle disposed beneath said dosaging device and centrally above said discharge opening for directing an air stream and said glass beads dosaged by said dosaging device downwardly and through said discharge opening, said nozzle having a tip portion which extends from said upper section of said discharge conduit into said intermediate section thereof; and drive means for said dosaging device which is responsive to the drive speed of a roadway marking machine, said drive means including a drive shaft on which said bucket wheel is mounted, the rotational speed of which is proportional to the drive speed of the machine and a clutch coupled to said drive shaft.

* * * * *